US011166614B2

(12) United States Patent
Takale et al.

(10) Patent No.: US 11,166,614 B2
(45) Date of Patent: Nov. 9, 2021

(54) DISHWASHER WITH SPRAY SYSTEM ASSEMBLY

(71) Applicant: Whirlpool Corporation, Benton Harbor, MI (US)

(72) Inventors: Mohan Takale, Stevensville, MI (US); Joseph Allen Gregory, Niles, MI (US); Lisa M. Fehner, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 171 days.

(21) Appl. No.: 15/944,279

(22) Filed: Apr. 3, 2018

(65) Prior Publication Data

US 2019/0298145 A1 Oct. 3, 2019

(51) Int. Cl.

| | |
|---|---|
| ***A47L 15/22*** | (2006.01) |
| ***A47L 15/23*** | (2006.01) |
| *A47L 15/42* | (2006.01) |

(52) U.S. Cl.

CPC ..... *A47L 15/22* (2013.01); *A47L 15/23* (2013.01); *A47L 15/4221* (2013.01)

(58) Field of Classification Search

CPC ..... A47L 15/22; A47L 15/23; A47L 15/4221
See application file for complete search history.

(56) References Cited

U.S. PATENT DOCUMENTS

| | | | | |
|---|---|---|---|---|
| 4,869,428 | A | 9/1989 | Gombar | |
| 5,727,581 | A | 3/1998 | Tekriwal et al. | |
| 6,705,330 | B1 | 3/2004 | Favret | |
| 9,032,980 | B2 | 5/2015 | Busing et al. | |
| 9,462,925 | B2 | 10/2016 | Boyer | |
| 9,763,554 | B2 | 9/2017 | Watson et al. | |
| 2004/0069332 | A1 | 4/2004 | LeBaron | |
| 2009/0266386 | A1 | 10/2009 | Haltmayer et al. | |
| 2011/0114139 | A1* | 5/2011 | Buesing | A47L 15/4221 134/198 |
| 2012/0111380 | A1* | 5/2012 | Bayer | A47L 15/23 134/198 |
| 2012/0266924 | A1* | 10/2012 | Boyer | F16K 11/074 134/198 |
| 2016/0287050 | A1 | 10/2016 | Dreossi et al. | |

FOREIGN PATENT DOCUMENTS

| | | | |
|---|---|---|---|
| CN | 205625852 | U | 10/2016 |
| CN | 105662306 | B | 5/2018 |
| DE | 9211182 | U1 | 2/1994 |
| DE | 102011081562 | A1 | 2/2013 |

(Continued)

OTHER PUBLICATIONS

Machine English translation of description of DE 102011081562 A1 (Heisele) (Year: 2013).*

(Continued)

*Primary Examiner* — Irina Graf
(74) *Attorney, Agent, or Firm* — McGarry Bair PC

(57) ABSTRACT

A spray system assembly for a household appliance, such as a dishwasher, wherein the spray system assembly can include a diverter housing with a diverter valve, a sprayer mount, and a rotatable sprayer. The rotatable sprayer can include a hub and a spray head. The hub of the rotatable sprayer is removably attached to the sprayer mount that is coupled to the diverter housing.

21 Claims, 6 Drawing Sheets

(56) References Cited

FOREIGN PATENT DOCUMENTS

| | | | |
|---|---|---|---|
| GB | 1462398 | A | 1/1977 |
| JP | 5921965 | B2 | 5/2016 |
| KR | 200341841 | | 2/2004 |

OTHER PUBLICATIONS

Machine English translation of Description of DE 9211182 U1 (Licentia, Dec. 1993) (Year: 1993).*

European Patent Office, European Search Report re Application No. 19162678.7-1018, dated Oct. 15, 2 019, 8 pages, Munich, Germany.

https://www.ebay.com/p/Electrolux-Frigidaire-Dishwasher-Lower-Spray-Arm-154568002-Ap3889833-Ps1524956/2255475767?iid=301501805682, Electrolux Frigidaire Dishwasher Lower Spray Arm 154568002 Ap3889833 Ps1524956, accessed Apr. 3, 2018.

Joezomby1, Removing Lower Spray Arm In GE Dishwasher, Youtube, Published Jul. 22, 2017, https://www.youtube.com/watch?v=03u8UTS1CKE at 0:03 / 0:23.

Banggood, "360 Degree Rotating Garden water sprinkler 3-Arm Fitting Hose outdoor spray Lawn sprinkle", webpage <https://usa.banggood.com/360-Degree-Rotating-Garden-Water-Sprinkler-3-Arm-Fitting-Hose-Outdoor-Spray-Lawn-Sprinkle-p-1568355.html?utm_source=googleshopping&utm_medium=cpc_organic&gpla=1&gmcCountry=US&utm_content=shopping&utm_campaign=usg-.

* cited by examiner

DISHWASHER WITH SPRAY SYSTEM ASSEMBLY

BACKGROUND

Contemporary automatic dishwashers for use in a typical household include a tub and upper and lower racks or baskets for supporting soiled dishes within the tub. A spray system is provided for re-circulating wash liquid throughout the tub to remove soils from the dishes. The spray system can include a spray system assembly that has at least one removable component. The dishwasher can also include a controller that implements a number of pre-programmed cycles of operation to wash dishes contained in the tub.

BRIEF DESCRIPTION

In one aspect, the disclosure relates to a dishwasher with at least one automatic cycle of operation. The dishwasher includes a tub that defines at least part of a treating chamber for treating dishes, a recirculation circuit having an inlet and an outlet, and a sprayer mount fluidly coupled to the outlet with a first threaded portion. The dishwasher also includes a rotatable sprayer with a spray head and a hub with a second threaded portion. The second threaded portion is threadable with the first threaded portion and spatially related so that the second threaded portion is threaded onto and beyond the first threaded portion when the rotatable sprayer is coupled to the sprayer mount.

Another aspect of the present disclosure relates to an assembly for a dishwasher that includes a diverter valve having a housing incorporating a sprayer mount that includes a first threaded portion. The assembly also includes a rotatable sprayer with a spray head and a hub having a second threaded portion. The second threaded portion is threadable with the first threaded portion and spatially related so that the second threaded portion is threaded onto and beyond the first threaded portion when the rotatable sprayer is coupled to the sprayer mount.

DESCRIPTION

Figure 1:
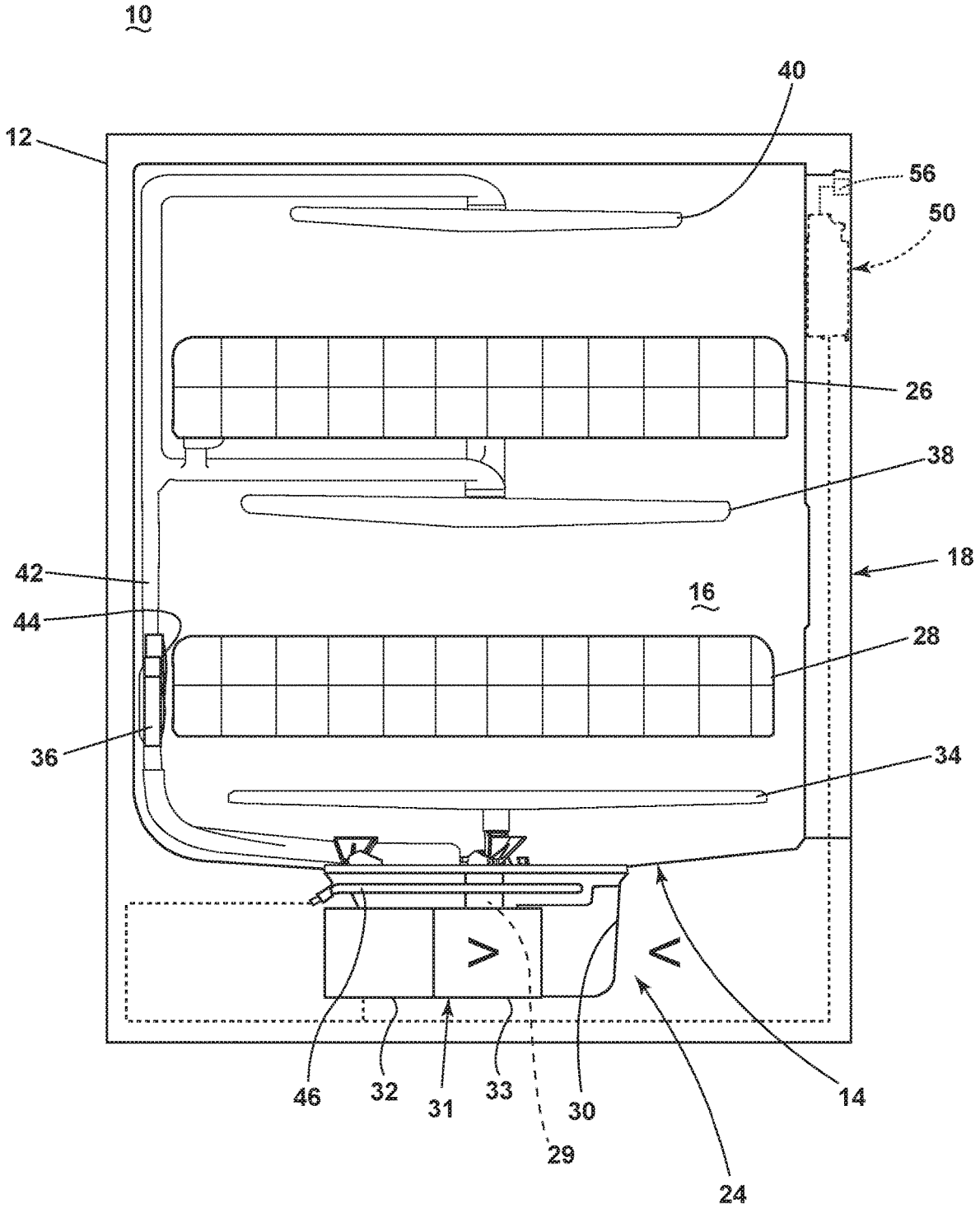
FIG. 1 is a schematic, cross-sectional view of a dishwasher having a spray assembly with a removable sprayer according to an aspect of the disclosure.

The aspects of the present disclosure are generally directed toward a spray system assembly for a dishwasher in which at least one component of the spray system assembly is threadably removable. The spray system assembly can include, but is not limited to, a bearing and a rotatable sprayer. The bearing can be a collar or part of a collar where the bearing or the bearing collar includes a first threaded portion. The rotatable sprayer includes a spray head and a hub with a second threaded portion. The rotatable sprayer can be attached to the bearing or bearing collar by threading the second threaded portion of the rotatable sprayer hub into the first threaded portion of the bearing or the bearing collar.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

In FIG. 1, an automated dishwasher 10 according to an aspect of the present disclosure is illustrated. A chassis 12 can define an interior of the dishwasher 10 and can include a frame, with or without panels mounted to the frame. An open-faced tub 14 can be provided within the chassis 12 and can at least partially define a treating chamber 16, having an open face for receiving dishes for treating. A door assembly 18 can be movably mounted to the dishwasher 10 for movement between opened and closed positions to selectively open and close the open face of the tub 14. Thus, the door assembly 18 provides accessibility to the treating chamber 16 for the loading and unloading of dishes or other washable items.

It should be appreciated that the door assembly 18 can be secured to the lower front edge of the chassis 12 or to the lower front edge of the tub 14 via a hinge assembly (not shown) configured to pivot the door assembly 18. When the door assembly 18 is closed, user access to the treating chamber 16 can be prevented, whereas user access to the treating chamber 16 can be permitted when the door assembly 18 is open.

Dish holders, illustrated in the form of upper and lower racks 26, 28, are located within the treating chamber 16 and receive dishes for washing. The upper and lower racks 26, 28 are typically mounted for slidable movement in and out of the treating chamber 16 for ease of loading and unloading. Other dish holders can be provided, such as a silverware basket. As used in this description, the term "dish(es)" is intended to be generic to any item, single or plural, that can be treated in the dishwasher 10, including, without limitation, dishes, plates, pots, bowls, pans, glassware, and silverware.

A spray system is provided for spraying liquid in the treating chamber 16 and can include, but is not limited to, a spray system assembly 34, a lower spray assembly 36, a rotating mid-level spray assembly 38, and/or an upper spray assembly 40. Upper spray assembly 40, mid-level spray assembly 38, and spray system assembly 34 are located, respectively, above the upper rack 26, beneath the upper rack 26, and beneath the lower rack 28 and are illustrated as rotating spray arms. The lower spray assembly 36 is illustrated as being located adjacent the lower rack 28 toward the rear of the treating chamber 16. The lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system 24 is provided for recirculating liquid from the treating chamber 16 to the spray system. An input 29 fluidly couples the recirculation system 24 and the tub 14. The recirculation system 24 can include a sump 30 and a pump assembly 31. The sump 30 collects the liquid sprayed in the treating chamber 16 and can be formed by a sloped or recess portion of a bottom wall of the tub 14. The pump assembly 31 can include both a drain pump 32 and one or more recirculation pumps 33. The drain pump 32 can draw liquid from the sump 30 and pump the liquid out of the dishwasher 10 to a household drain line (not shown). The recirculation pump 33 can draw liquid from the sump 30 and the liquid can be simultaneously or selectively pumped through a supply tube 42 to each of the assemblies 34, 36, 38, 40 for selective spraying. While not shown, a liquid supply system can include a water supply conduit coupled with a household water supply for supplying water to the treating chamber 16. The household water supply can include a household cold water supply, household hot water supply, or a mixture as desired.

A heating system including a heating element 46 can be located within the sump 30 for heating the liquid contained in the sump 30.

A controller 50 can also be included in the dishwasher 10, which can be operably coupled with various components of the dishwasher 10 to implement a cycle of operation. The controller 50 can be located within the door assembly 18 as illustrated, or it can alternatively be located somewhere within the chassis 12. The controller 50 can also be operably coupled with a control panel or user interface 56 for receiving user-selected inputs and communicating information to the user. The user interface 56 can include operational controls such as dials, lights, switches, and displays enabling a user to input commands, such as a cycle of operation, to the controller 50 and receive information.

Figure 2:
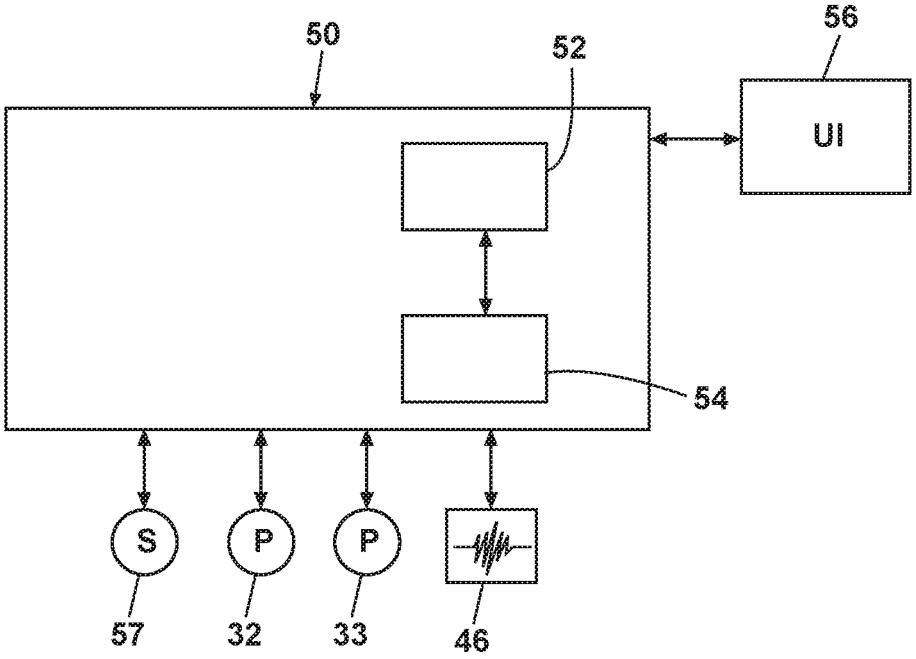
FIG. 2 is a schematic view of a controller of the dishwasher of FIG. 1.

As illustrated schematically in FIG. 2, the controller 50 can be coupled with the heating element 46 for heating the wash liquid during a cycle of operation, the drain pump 32 for draining liquid from the treating chamber 16, and the recirculation pump 33 for recirculating the wash liquid during the cycle of operation. The controller 50 can be provided with a memory 52 and a central processing unit (CPU) 54. The memory 52 can be used for storing control software that can be executed by the CPU 54 in completing a cycle of operation using the dishwasher 10 and any additional software. For example, the memory 52 can store one or more pre-programmed cycles of operation that can be selected by a user and completed by the dishwasher 10. The controller 50 can also receive input from one or more sensors 57. Non-limiting examples of sensors that can be communicably coupled with the controller 50 include a temperature sensor, humidity sensor, and turbidity sensor to determine the soil load associated with a selected grouping of dishes, such as the dishes associated with a particular area of the treating chamber 16.

Figure 3:
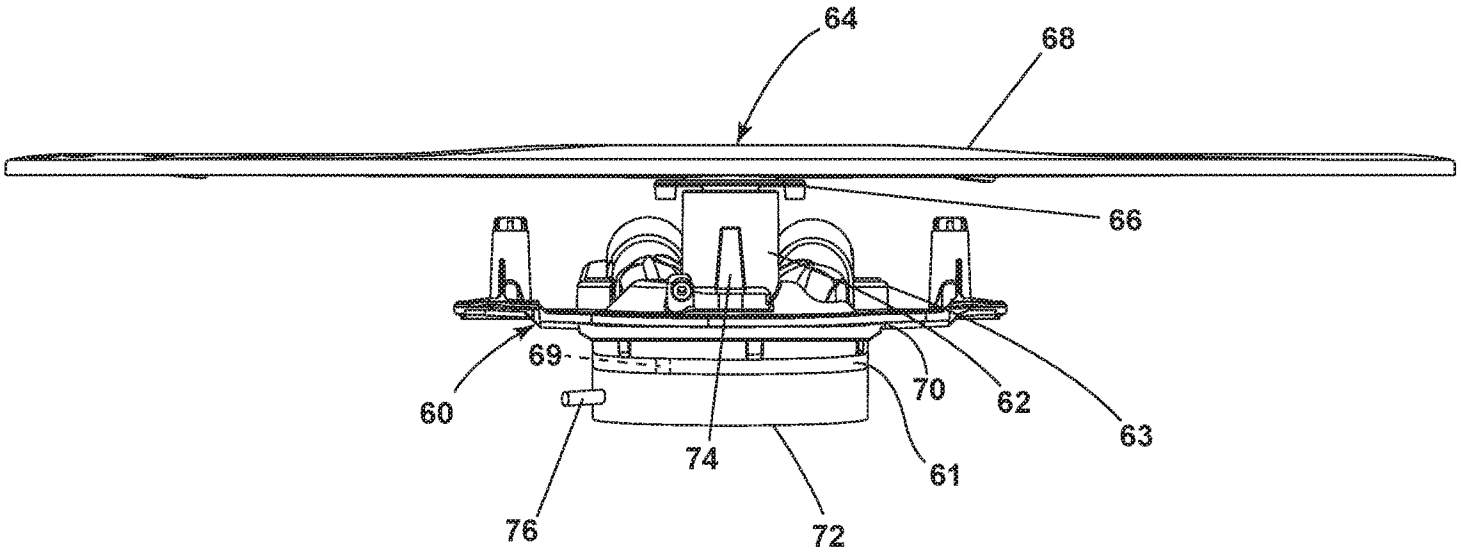
FIG. 3 is a side view of a spray assembly of the dishwasher of FIG. 1.

FIG. 3 is a side view of the spray system assembly 34 of the dishwasher 10 from FIG. 1 having the controller 50 of FIG. 2. The spray system assembly 34 can include, but is not limited to, a diverter housing 60 with a diverter valve 61, a sprayer mount 62, and a rotatable sprayer 64. The rotatable sprayer 64 can include, but is not limited to, a hub 66 and a spray head 68. The spray head 68 can include, but is not limited to, a spray tube, one or more spray arms, or a variety of nozzles as known in the art, or combinations thereof.

The diverter housing 60 includes the diverter valve 61. In a non-limiting example, the diverter valve 61 is illustrated as a disk with a through hole 69. As well known in the art, the diverter valve 61 can rotate so that the through hole 69 changes location. The diverter housing 60 can include an upper housing 70 above the diverter valve 61 and a lower housing 72 below the diverter valve. In a non-limiting example, the sprayer mount 62 can be mounted to the upper housing 70 of the diverter housing 60. The sprayer mount 62 can include a gap 74.

The diverter housing 60 fluidly couples an outlet 76 of the recirculation system 24 to the sprayer mount 62. The sprayer mount 62 can couple to the hub 66 of the rotatable sprayer 64. The hub 66 is fluidly coupled to the spray head 68 which is fluidly coupled to the treating chamber 16.

Figure 4:
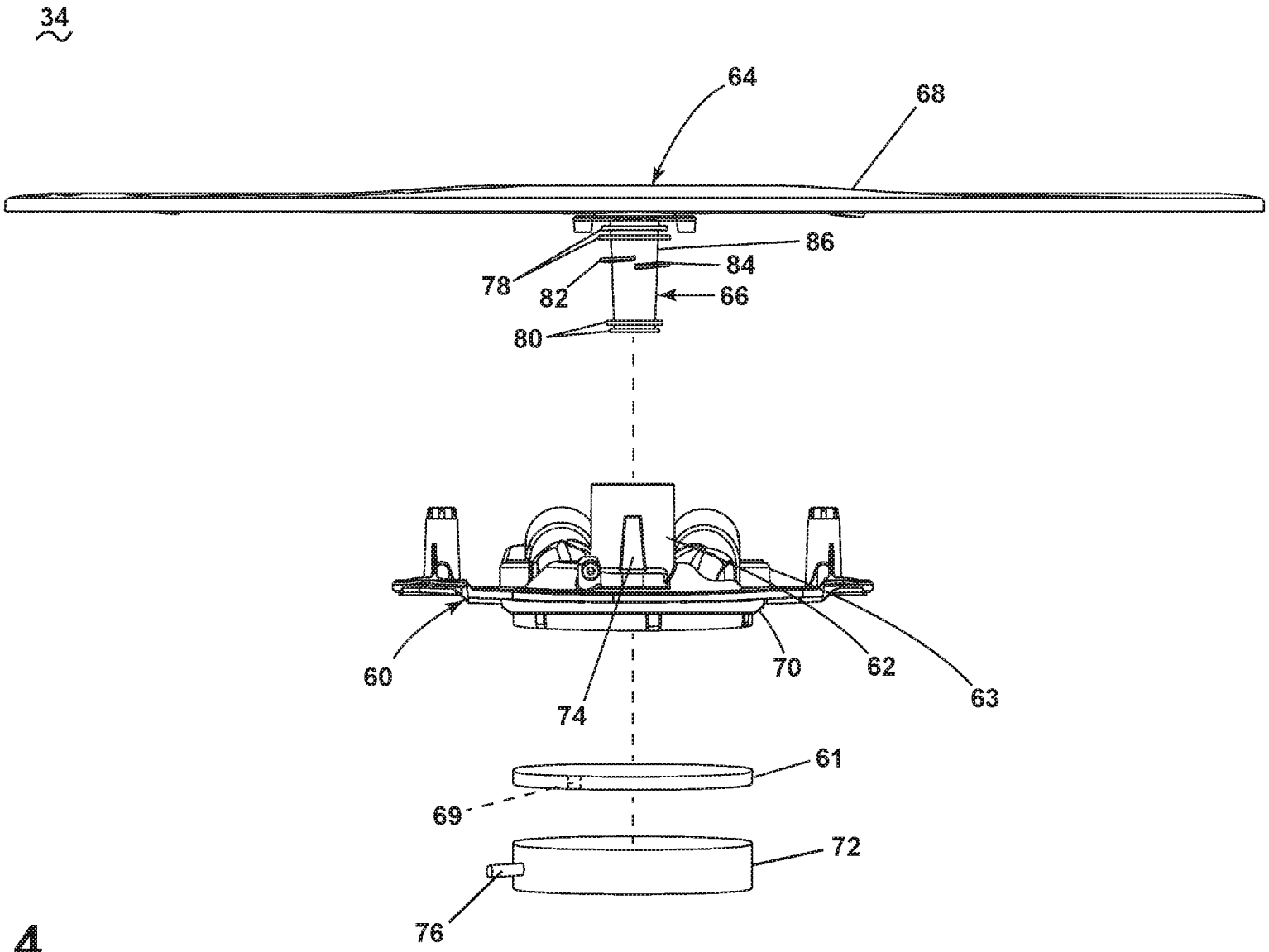
FIG. 4 is an exploded view of the spray assembly of FIG. 3 with a sprayer mount and a hub for a rotating sprayer.

FIG. 4 is an exploded view of the spray system assembly 34 of FIG. 3 and more clearly shows the hub 66 of the rotatable sprayer 64. The hub 66 can include, but is not limited to, upper sealing protrusions 78, lower sealing protrusions 80, and a second threaded portion 82. The second threaded portion 82 has a second thread distal end 84 and a second thread proximal end 86. The second threaded portion 82 is demonstrated in FIG. 4 as a convex thread that circumscribes the circumference of the hub 66 and can form one turn. Other non-limiting examples of the second threaded portion 82 include convex thread that is less than one circumference of the hub 66 forming less than one turn, or convex thread that circumscribes the circumference of the hub 66 forming more than one turn, or convex thread that circumscribes the circumference of the hub 66 at least twice forming two turns or more, or a concave area capable of engaging convex thread that is less than one circumference of the hub 66, or a concave area capable of engaging convex thread that circumscribes the circumference of the hub one or more times, or a protruding nub.

Figure 5:
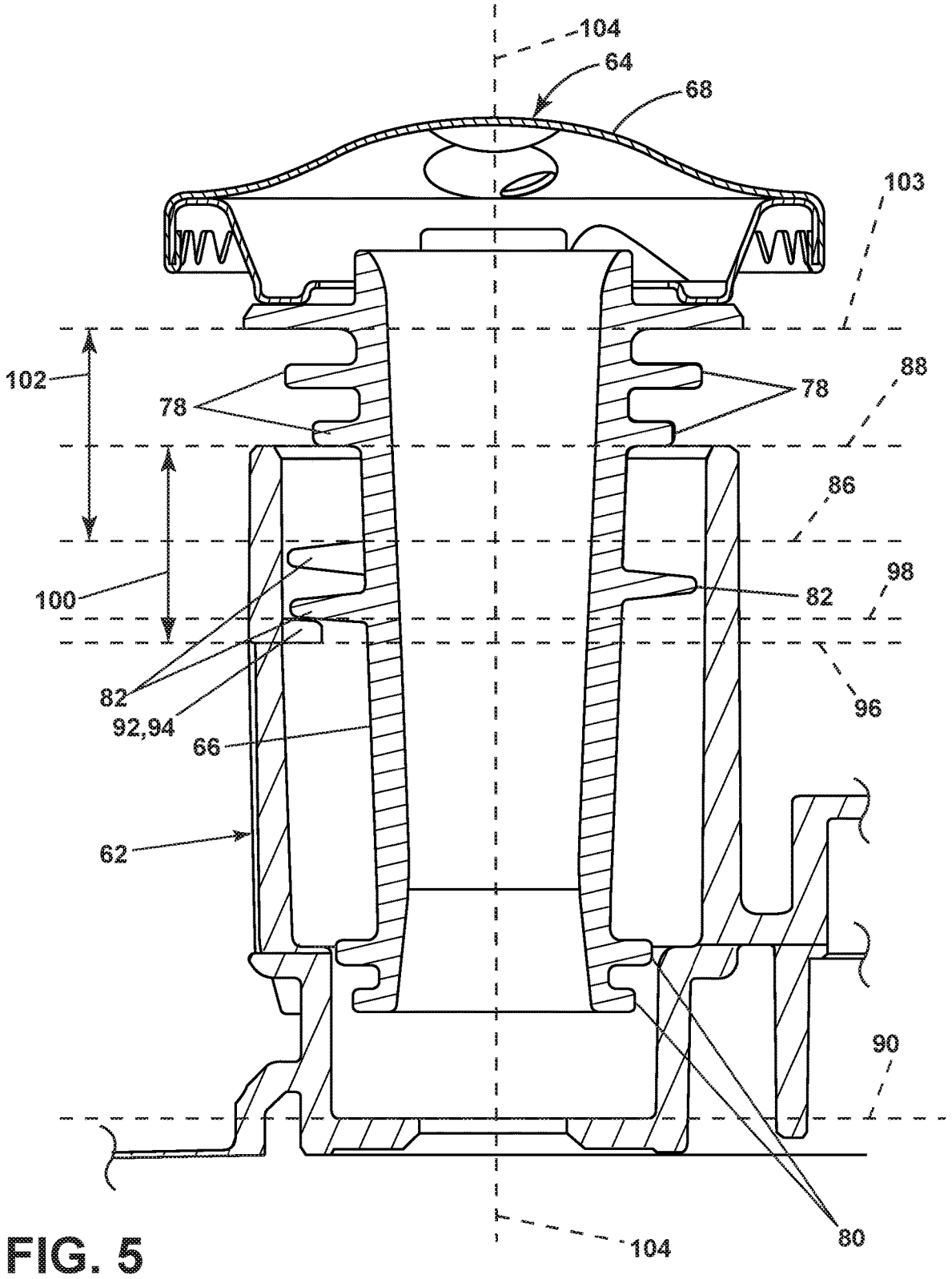
FIG. 5 is a cross-section view of the spray assembly of FIG. 4 with the sprayer mount and hub in a first position.

The remaining features of the hub 66 and the sprayer mount 62 are best seen in FIG. 5, which is a sectional view of the rotatable sprayer 64 shown in a first position where the hub 66 is seated in the sprayer mount 62, prior to the hub 66 being threadedly attached to the sprayer mount 62. The sprayer mount 62 has a sprayer proximal end 88 and a sprayer distal end 90.

The sprayer mount 62 can include a first threaded portion 92. The first threaded portion 92 is preferably located inside the sprayer mount 62, although it is not limited to this location, and can be located exteriorly. The first threaded portion 92 is demonstrated in as a protruding nub 94. The nub 94 can have, but is not limited to, an angled or contoured design. Other non-limiting examples of the first threaded portion 92 include a protruding convex thread that is less than one circumference or turn of the sprayer mount 62, or protruding convex thread that circumscribes the circumference of the sprayer mount 62 to form one or more turns, or a concave area capable of engaging convex thread that is less than one circumference or turn of the sprayer mount 62, or a concave area capable of engaging convex thread that circumscribes the circumference of the sprayer mount 62 to form one or more turns.

The first threaded portion 92 has a first thread distal end 96 and a first thread proximal end 98. A first distance 100 can be measured from the first thread distal end 96 to the sprayer proximal end 88 of the sprayer mount 62. The second threaded portion 82 has the second thread distal end 84 and the second thread proximal end 86. The second thread proximal end 86 is a second distance 102 from a base 103 of the spray head 68. The second distance 102 is greater than the first distance 100, which provides for a spatial relationship in which the second threaded portion 82 can be threaded through and beyond the first threaded portion 92. Once the second threaded portion 82 is threaded beyond the first threaded portion 92, the rotatable sprayer 64 can freely rotate clockwise and counterclockwise without unthreading from the sprayer mount 62.

The first and second threaded portions 92, 82 can have vertically-oriented centerlines. The vertically-oriented centerlines for the first threaded portions 92 and the second threaded portions 82 can include centerlines that are the same or centerlines that are different. A non-limiting example is a centerline 104 for the first threaded portions 92 and the second threaded portions 82.

Figure 6:
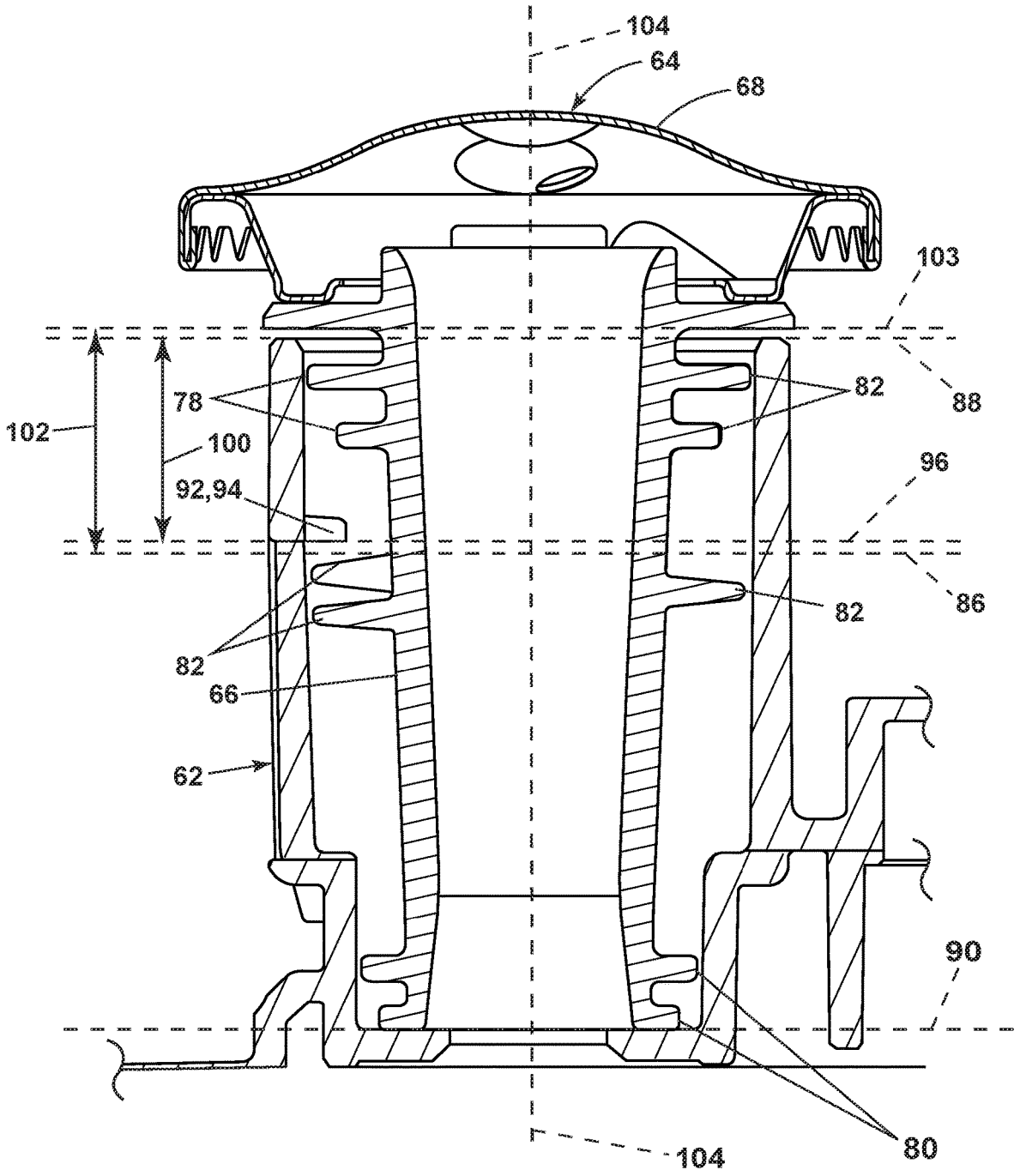
FIG. 6 is a cross-section view of the spray assembly of FIG. 4 with the sprayer mount and hub in a second position.

FIG. 6 illustrates a cross-sectional view of the hub 66 and the sprayer mount 62 in a second position. The second position in FIG. 6 illustrates the hub 66 coupled to the sprayer mount 62, where the seconded threaded portion 82 is threaded into and beyond the first threaded portion 92. When the seconded threaded portion 82 is threaded into and beyond the first threaded portion 92, the sprayer mount 62 abuts the hub 66 at the bottom or the sprayer distal end 90.

In operation, the hub 66 of the rotatable sprayer 64 can be placed in the sprayer mount 62, illustrated as the first position in FIG. 5. The rotatable sprayer 64 can be rotated about the centerline 104. The rotational direction for threading the rotatable sprayer 64 can be in the same or the opposite of an operational direction of rotation. Rotation of the rotatable sprayer 64 in the rotational direction for threading causes the second threaded portion 82 of the hub 66 to be threaded into the first threaded portion 92 of the sprayer mount 62. The rotatable sprayer 64 is coupled in an over-threaded position to the sprayer mount 62 once the second threaded portion 82 extends beyond the first threaded portion 92. The over-threaded position is illustrated in FIG. 6 when the hub 66 and the sprayer mount 62 are in the second position.

Once the rotatable sprayer 64 is threaded to the sprayer mount 62, as illustrated in FIG. 6 as the second position, the rotatable sprayer 64 is free to rotate in either a clockwise or counterclockwise direction without fear of uncoupling. FIG. 6 illustrates a non-limiting example in which a retaining force (illustrated as a gravitational force in FIG. 6) contributes to keeping the rotatable sprayer 64 in the second position. The aspects of the present disclosure could be implemented in any orientation and the retaining force can be attained using additional components to provide a force with a similar effect. Additional components can include, but are not limited to one or more magnets to provide a magnetic retaining force or one or more springs to provide elastic retaining force.

The rotatable sprayer 64 will remain engaged to the sprayer mount 62 until the rotatable sprayer 64 is pushed or pulled in a direction parallel to the central axis centerline 104 that is in the opposite direction and overcomes the retaining force. The push or pull that overcomes the retaining force will also bring the second thread proximal end 86 into contact with the first thread distal end 96. In one aspect of the present disclosure, the rotatable sprayer 64 shown in FIG. 6, can be lifted vertically to offset the gravitational retaining force so that the second thread proximal end 86 comes into contact with the first thread distal end 96. While pushing or pulling (i.e. lifting vertically), the rotatable sprayer 64 can be rotated in the opposite direction for threading until the second threaded portion 82 disengages from the first threaded portion 92. This occurs once the second thread distal end 84 reaches the first thread proximal end 98. The rotatable sprayer 64 can then be removed from the sprayer mount 62.

When the rotatable sprayer 64 is threadably coupled to the sprayer mount 62, as shown in FIG. 6 as second position, fluid from the recirculation system 24 can flow through the outlet 76 into the lower housing 72 of the diverter housing 60. The diverter valve 61 fluidly connects the lower housing 72 to the upper housing 63 providing fluid to the sprayer mount 62 and the hub 66. Fluid flowing through the hub 66 exits into the treating chamber 16 through the spray head 68. As the spray head 68 of the rotatable sprayer 64 receives fluid, it begins to rotate. The rotation of the rotatable sprayer 64 can help to secure the hub 66 to the sprayer distal end 90 of the sprayer mount 62.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dishwasher for treating dishes according to at least one automatic cycle of operation, the dishwasher comprising:

a tub at least partially defining a treating chamber receiving dishes for treating;

a recirculation circuit fluidly coupled to the tub and having an inlet and an outlet;

a diverter valve assembly including a diverter housing fluidly coupled to the recirculation circuit, a sprayer mount extending from a portion of the diverter housing, the sprayer mount having a first threaded portion extending from an inside wall of the sprayer mount and a diverter valve located within the diverter housing and selectively fluidly coupling the sprayer mount to the recirculation circuit; and a rotatable sprayer comprising a spray head and a hub extending therefrom, the hub having a second threaded portion, which is threadable via turning with the first threaded portion to couple the rotatable sprayer to the sprayer mount;

wherein the first threaded portion and the second threaded portion are spatially related such that the second threaded portion is threaded onto and beyond the first threaded portion when the rotatable sprayer is coupled to the sprayer mount and the first threaded portion comprises a single nub.

2. The dishwasher of claim 1 wherein the first and second threaded portions have vertically-oriented centerlines.

3. The dishwasher of claim 1 wherein the first threaded portion comprises the nub and the second threaded portion comprises more than one turn.

4. The dishwasher of claim 3 wherein the first threaded portion comprises the nub and the second threaded portion comprises more than two turns.

5. The dishwasher of claim 1 wherein a rotational direction of threading of the second threaded portion into the first threaded portion is in an operational direction of rotation of the rotatable sprayer.

6. The dishwasher of claim 5 wherein during installation the threading of the second threaded portion into the first threaded portion is in the operational direction of rotation of the rotatable sprayer.

7. The dishwasher of claim 6 wherein for removal, the second threaded portion is lifted and unthreaded via turning from the first threaded portion in an opposite direction of the operational direction of rotation of the rotatable sprayer.

8. The dishwasher of claim 1 wherein the spray head comprises a spray arm.

9. The dishwasher of claim 1 wherein the hub defines a length and the second threaded portion is spaced from a base of the spray head and spaced from a distal end of the hub that is away from the spray head.

10. The dishwasher of claim 1 wherein the hub further comprises at least one sealing protrusion extending radially away from the hub and configured to be received within the sprayer mount.

11. The dishwasher of claim 1 wherein the first threaded portion comprises the nub, wherein the nub is a convex portion that extends from the inside wall of the sprayer mount, wherein the nub is received by concave portions of the second threaded portion when the first threaded portion and the second threaded portion are threaded together via turning.

12. An assembly for a dishwasher comprising:

a diverter valve having a housing incorporating a sprayer mount having a first threaded portion; and a rotatable sprayer comprising a spray head defining a base and a hub extending from the base and defining a length with a second threaded portion, the second threaded portion located along the length and spaced from the base and spaced from a distal end of the hub that is opposite the base, the second threaded portion threadable via turning with the first threaded portion and spatially related such that the second threaded portion is threaded into and beyond the first threaded portion when the rotatable sprayer is coupled to the sprayer mount, wherein the first threaded portion comprises a nub, wherein the nub is a convex portion that extends from an inside wall of the sprayer mount, and wherein the nub is received by concave portions of the second threaded portion when the first threaded portion and the second threaded portion are threaded together via turning.

13. The assembly of claim 12 wherein the first and second threaded portions have vertically-oriented centerlines.

14. The assembly of claim 12 wherein the first threaded portion comprises the nub and the second threaded portion comprises more than one turn.

15. The assembly of claim 14 wherein the first threaded portion comprises the nub the second threaded portion comprises more than two turns.

16. The assembly of claim 12 wherein a rotational direction of threading of the second threaded portion into the first threaded portion is in an operational direction of rotation of the rotatable sprayer.

17. The assembly of claim 16 wherein for removal, the second threaded portion is lifted and unthreaded via turning from the first threaded portion in an opposite direction of the operational direction of rotation of the rotatable sprayer.

18. The assembly of claim 12 wherein the spray head comprises a spray arm.

19. The assembly of claim 12 wherein the sprayer mount is fluidly coupled to a recirculation circuit in the dishwasher.

20. The assembly of claim 12 wherein the hub further comprises at least one sealing protrusion extending radially away from the hub and configured to be received within the sprayer mount.

21. dishwasher for treating dishes according to at least one automatic cycle of operation, the dishwasher comprising:

a tub at least partially defining a treating chamber receiving dishes for treating;

a recirculation circuit fluidly coupled to the tub and having an inlet and an outlet;

a diverter valve assembly including a diverter housing fluidly coupled to the recirculation circuit, a sprayer mount extending from a portion of the diverter housing, the sprayer mount having a first threaded portion, and a diverter valve located within the diverter housing and selectively fluidly coupling the sprayer mount to the recirculation circuit; and a rotatable sprayer comprising a proximal end having a spray head and a distal end having a hub extending therefrom, the hub having a second threaded portion, which is threadable, via turning, with the first threaded portion to couple the rotatable sprayer to the sprayer mount, the hub including a first and second set of annular sealing protrusions for sealing a space between the hub and the spray mount, the first set of annular sealing protrusions extending radially away from the hub and located between a base of the spray head and the second threaded portion, and the second set of annular sealing protrusions extending radially away from the hub and located between the second threaded portion and the sprayer distal end;

wherein the first threaded portion and the second threaded portion are spatially related such that the second threaded portion is threaded onto and beyond the first threaded portion when the rotatable sprayer is coupled to the sprayer mount.

* * * * *